US005293821A

United States Patent [19]

True et al.

[11] Patent Number: 5,293,821

[45] Date of Patent: Mar. 15, 1994

[54] DELAY INITIATOR FOR BLASTING

[75] Inventors: Donald C. True; Raymond Carriere, both of Brownsburg, Canada

[73] Assignee: ICI Canada Inc., North York, Canada

[21] Appl. No.: 541,959

[22] Filed: Jun. 22, 1990

[51] Int. Cl.[5] ..... C06C 5/00

[52] U.S. Cl. ..... 102/275.6; 102/275.12; 102/315

[58] Field of Search ..... 102/315, 275.6, 275.12

[56] References Cited

U.S. PATENT DOCUMENTS

| | | | |
|---|---|---|---|
| 3,580,171 | 5/1971 | Maes | 102/28 |
| 3,611,939 | 10/1971 | Stadler et al. | 102/46 |
| 3,719,144 | 3/1973 | Tlam | 102/28 R |
| 3,793,920 | 2/1974 | Sheran | 86/1 R |
| 3,867,885 | 2/1975 | Gawlick et al. | 102/28 |
| 3,885,499 | 5/1975 | Hurley | 102/23 |
| 4,718,345 | 1/1988 | Yunan | 102/275 |
| 4,776,275 | 10/1988 | Holzinger et al. | 102/275.3 |
| 4,821,646 | 4/1989 | True et al. | 102/322 |
| 4,920,883 | 5/1990 | Barker | 102/202.5 |

*Primary Examiner*—Peter A. Nelson
*Attorney, Agent, or Firm*—Gerald A. Gowan

[57] ABSTRACT

A novel initiator (blasting cap) for explosives is provided. The initiator, which may be electric or non-electric, comprises a principal tubular metal shell containing a base charge, a delay charge, a priming charge and an ignition means, wherein the base charge and priming charge are housed within a reduced diameter tubular metal shell, which reduced diameter shell is located within but separated from the principal shell by a void space. The construction results in a markedly improved resistance against shock initiation.

7 Claims, 2 Drawing Sheets

DELAY INITIATOR FOR BLASTING

This invention relates to blasting initiators, and more particularly, to delay initiators, of both electric and non-electric types, which demonstrate improved resistance to premature shock initiation.

Delay blasting initiators or detonators are well known in the art and normally consist of a metal or plastic shell or tube, closed at one end and containing a base charge of a secondary explosive, such as pentaerythritol tetranitrate (PETN), and a priming charge of a primary explosive such as lead azide located immediately adjacent to the base charge. Adjacent the priming charge is a delay charge such as a silicon/red lead mixture, also known as a delay element, which burns at a controlled rate and is typically housed within a malleable metal delay train. An ignition charge of, for example, a boron/red lead mixture, is located adjacent to the delay charge.

The ignition charge in an electric detonator is activated electrically, for example, by an exploding bridge wire, or, in a non-electric detonator, by means of energy provided by a detonating cord or shock tube. The activated ignition charge reacts immediately and initiates the adjacent delay charge.

The delay charge, once initiated, burns through to the priming charge at a controlled rate. Thus, the delay charge introduces a time lag between the activation of the ignition charge and the detonation of the base charge, by delaying initiation of the priming charge until the delay charge has burned through to the priming charge. The length of the time delay for each initiator is controlled by the length of the delay charge.

Once the priming charge is initiated, it explodes with sufficient force to initiate the adjacent base charge. The base charge explodes with sufficient energy to initiate the explosive material which is outside of the blasting cap.

In multiple charge blasting operations, a number of closely spaced explosive-charged boreholes are advantageously detonated in a planned sequence employing milli-second (MS) delay blasting detonators. Use of such split-second techniques results in substantially improved blasting results in terms of improved fragmentation, reduced vibration and backbreak and minimized cut-offs.

Briefly described, in split-second blasting, a single charged borehole or a row of charged holes is detonated at one point in time, a second adjacent charged hole or row of charged holes is detonated after a millisecond delay time interval, a third charged row at a further short delayed interval, etc. The delay between detonation of each row is achieved by providing blasting detonators having a built-in delay feature, the delays ranging from about 10 MS to about 9000 MS.

A problem which has persisted in the use of split-second delay blasting techniques has been the inadvertent, premature detonation of blasting detonators in nearby holes caused by shock transmitted through the terrain from an earlier detonated charge. When this occurs, the carefully planned sequence of delay blasting is upset resulting in unsatisfactory blasting results.

It can be demonstrated by underwater shock testing of conventional detonators having a base charge of a secondary explosive, that when the exterior of the detonator shell is exposed to a high pressure pulse of about 15000–20000 psi., the base charge of secondary explosive is deflagrated or detonated. The magnitude of the pressure pulse required to cause deflagration or detonation is dependent, inter alia, on the secondary explosive used.

When deflagration of the base charge occurs, the detonator shell is burst open from internal pressure without initiating the adjacent primer or explosive charge. When pressure-induced or sympathetic detonation occurs, the detonation causes the charged borehole to detonate out of the planned sequence.

In U.S. Pat. No. 4,821,646 a delay initiator having improved resistance against shock initiation is described wherein an annular collar or wiper ring is located within the inner walls of the detonator between the delay train and the priming charge. However, further improvements in the resistance to shock initiation are desirable.

Surprisingly, it has been found that encasing the base charge and priming charge in a second inner shell inside of the standard detonator shell, provides improved resistance to premature shock initiation of the detonator.

It is an object of the present invention to provide a delay blasting detonator which demonstrates a substantially improved resistance against shock or sympathetic initiation.

It is a further object of the present invention to provide a delay blast detonator which demonstrates a substantially improved resistance against shock or sympathetic initiation with no significant loss in output energy.

Additional objects of the invention will be evident upon consideration of the ensuing description.

Accordingly, the present invention provides an improved time-delay blasting initiator comprising a principal tubular metal shell closed at one end, a base charge of explosive within said principal shell, a priming charge adjacent said base charge, a delay charge adjacent said priming charge and an ignition means adjacent said delay charge, characterized in that said initiator further comprises a secondary shell being of smaller diameter than said principal shell and so positioned within said principal shell as to provide a circumferential void space, and wherein at least one of said base charge, said priming charge, and said delay charge is contained within said secondary shell.

In a preferred embodiment, the present invention provides a delay blasting initiator as defined hereinabove, wherein said one end of said secondary shell is closed, and said base charge, said priming charge and a major part of said delay charge are contained within said secondary shell.

In a more preferred embodiment, said secondary shell and said principal shell are maintained apart by means of a resilient, ring-shaped spacer element provided therebetween. The resulting circumferential void space between the primary and secondary shells is normally an air gap, but in a further preferred embodiment, the void is filled with an energy absorbing material such as rubber, or styrofoam.

The principal shell of the initiator is preferably made from a material which is resistant to deformation. Suitable materials include, but are not limited to, copper and steel. Preferably, the principal shell is of the same diameter as standard blasting caps known within the industry.

The detonator of the invention may be more fully illustrated by reference to the accompanying drawings wherein.

Figure 1:
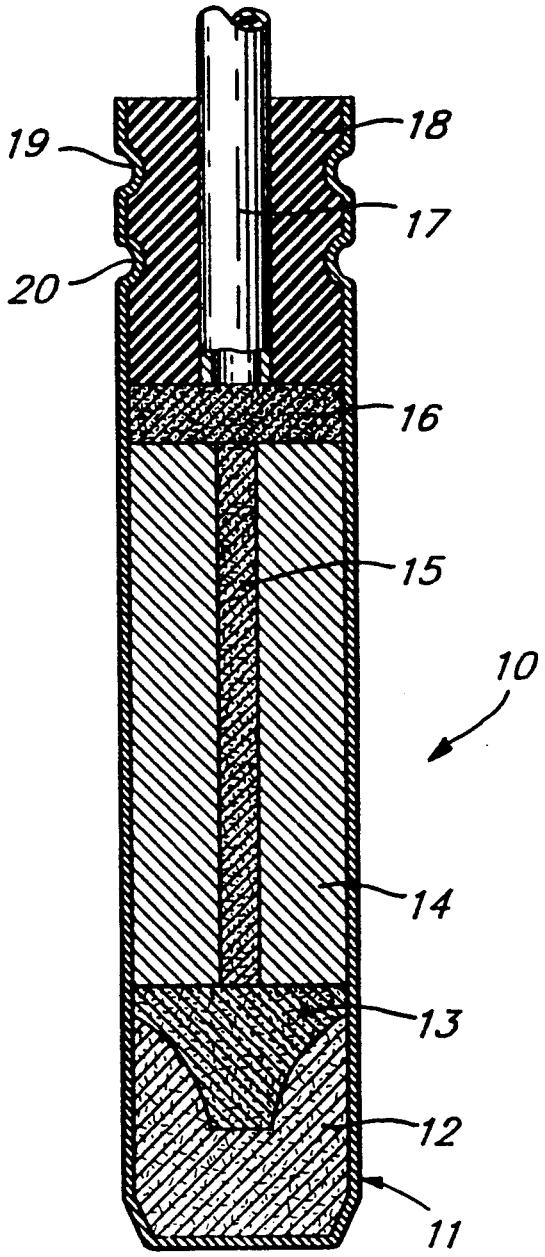
FIG. 1 (prior art)
FIG. 1 is a cross-sectional longitudinal view of a non-electric delay detonator according to the prior art.

Referring to FIG. 1, a non-electric detonator 10 is shown having an elongated tubular metal shell 11 which shell is made of copper. One end of shell 11 is closed. At the closed end of shell 11 is a base charge 12 of pentaerythritol tetranitrate (PETN) as a detonating secondary explosive. Priming charge 13 of lead azide, as a primary explosive, covers base charge 12. Adjacent the priming charge 13 is a malleable lead metal delay train 14 which supports and contains a delay charge, or delay element, 15 of a silicon/red lead mixture. Adjacent the delay train 14 and delay charge 15 is an ignition charge 16 of a boron/red lead mixture. Located adjacent the ignition charge 16 is a shock wave conductor 17 terminating at the ignition charge 16 and held within the end of shell 11 by means of a plug 18. Peripheral crimps 19 and 20 hold plug 18 within tube 11.

In the assembly of the detonator depicted in FIG. 1, the base charge 12 is introduced into shell 11 and pressed with a pointed end or rounded end rod or pin to produce a depression or recess on the surface of charge 12. Priming charge 13 is then placed into shell 11, filling the recess in base charge 12. The priming charge 13 may optionally be pressed. Delay train 14, containing delay charge 15, is then pressed into shell 11. Ignition charge 16 is introduced into shell 11 after which an assembly comprising shock tube 17, and plug 18 is pressed into shell 11 until the base of plug 18 is flush with the surface of charge 16. Peripheral crimps 19 and 20 secure plug 18 within shell 11.

Figure 2:
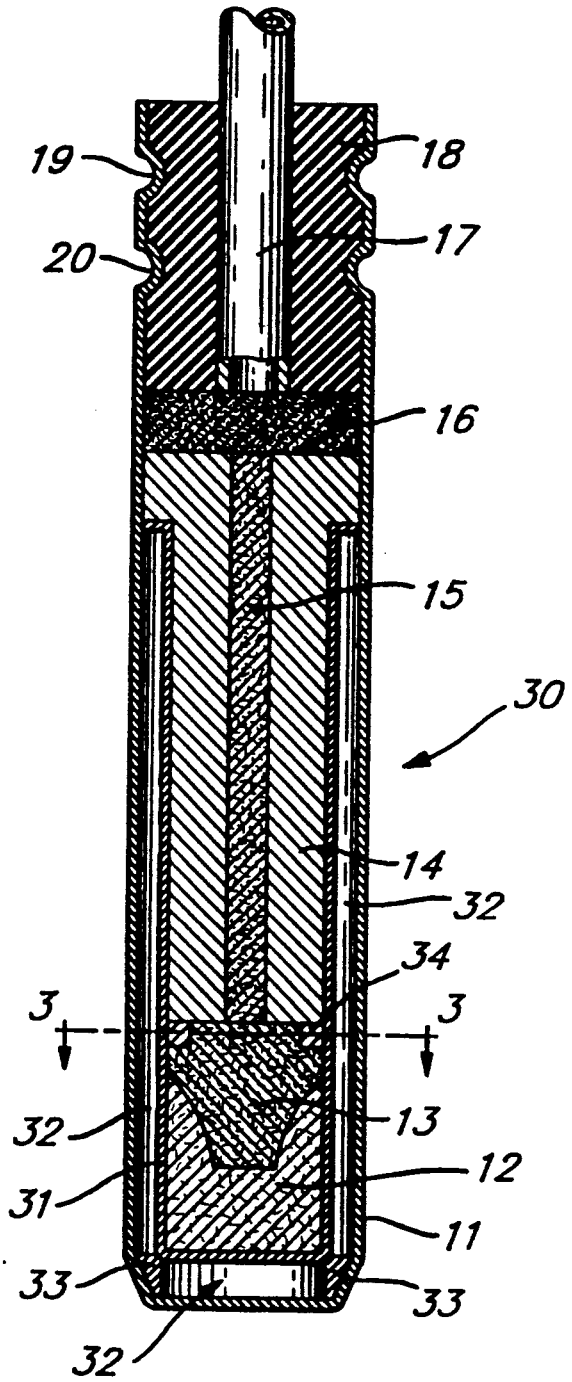
FIG. 2 is a cross-sectional longitudinal view of a typical non-electric blasting detonator of the present invention.

In FIG. 2, a detonator 30 according to the present invention is shown wherein like items are identified by the same reference numbers as were used in FIG. 1. Referring to FIG. 2, detonator 30 also has an elongated, tubular principal shell 11 of copper, which principal shell 11 is also closed at one end. Within principal shell 11 is a base charge 12, a priming charge 13, a delay train 14 containing a delay charge 15, an ignition charge 16, a shock tube 17 and a plug 18. Plug 18 is secured within shell 11 by crimps 19 and 20. According to the present invention, base charge 12, priming charge 13, and most of delay train 14 containing delay charge 15 are housed within a reduced diameter, secondary shell 31 within principal shell 11. Secondary shell 31 is positioned within principal shell 11 in a manner so that a void space 32 is created between the respective ends and walls of the two shells. Secondary shell 31 is maintained spaced away from principal shell 11 by means of a retaining ring 33 of resilient polyethylene.

As discussed hereinabove, U.S. Pat. No. 4,821,646 describes a shock resistant detonator wherein improved shock resistance is provided by placing a tight-fitting, annular "wiper" ring of a resilient material within the detonator at the interface between the priming charge and the delay train. This feature has also been included in the detonator described in FIG. 2, where a polyethylene wiper ring 34 is located at the interface between the priming charge 13 and delay train 14.

Assembly of the detonator of the present invention as shown in FIG. 2, is similar to assembly of the detonator as shown in FIG. 1. Base charge 12 is introduced into secondary shell 31 and pressed into place with a pointed end or rounded end pin to produce a depression or recess on the surface of base charge 12. Priming charge 13 is introduced into secondary shell 31 and pressed into the depression in base charge 21. Resilient, tight-fitting, annular wiper ring 34 is then pressed downward along the inner wall of secondary shell 31 to rest close to the surface of priming charge 22. During its passage, wiper ring 34 effectively sweeps away any fine particles of priming charge material 13 which may be adhering to the inner wall of secondary shell 31. Thus assembled, the charged secondary shell 31 is inserted into principal shell 11 so that it rests upon a resilient retaining ring 33 that has been placed at the base of principal shell 11. Retaining ring 33 provides a means for ensuring that a void space is maintained between principal shell 11 and secondary shell 31.

Delay train 14 which has an outer diameter adapted to fit within the upper confines of secondary shell 31, is pressed into secondary shell 31 and against wiper ring 34. The lower end of delay train 14 is in physical contact with the surface of priming charge 13. The pressing action against it causes train 14 to reduce in length and to expand outwardly against the inner wall of principal shell 11, effectively sealing secondary shell 31 within the base of principal shell 11 and maintaining secondary shell 31 centrally within principal shell 11. After delay train 14 is pressed in place, an ignition charge 16 is introduced into principal shell 11, and an assembly comprising shock tube 17 and plug 18 are pressed into principal shell 11 until the base of plug 18 is flush with the surface of ignition charge 16. Peripheral crimps 19 and 20 secure plug 18 within principal shell 11.

Figure 3:
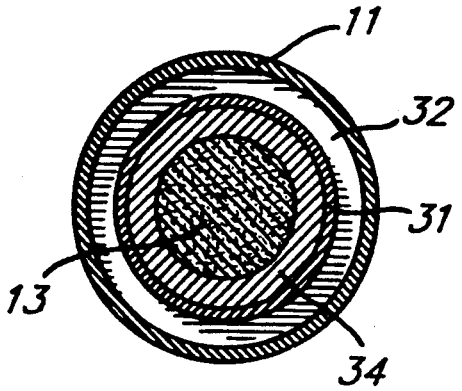
FIG. 3 is a cross-sectional view of the detonator of FIG. 2 along the line 3—3.

The construction of initiator 30, at the interface of wiper ring 34 is more clearly shown in FIG. 3. Wiper ring 34 is located around the circumference of the inner wall of secondary shell 31 and is adjacent to priming charge 13. Delay train 14 (not shown) is inserted into secondary shell 31 and rests adjacent wiper ring 34 and priming charge 13. Secondary shell 31 is positioned within primary shell 11 so as to create a circumferential void area 32 around secondary shell 31.

The material of construction of secondary shell 31 and principal shell 11 may be the same or different so long as principal shell 11 is resistant to deformation and is resistant to transmitting shock or sound waves. Copper or steel or other high yield strength materials are appropriate for principal shell 11. The material of secondary shell 31 may be the same as the principal shell, although a more deformable material, such as, aluminum, is satisfactory.

The detonator of the present invention is particularly adapted to withstand the shock of impact which is often present in multiple charge blasting operations. To demonstrate the improved shock resistance of the detonator of the present invention, testing was undertaken as described in the following Examples.

EXAMPLE 1

Underwater shock tests were conducted in a test pond. Explosive charges comprising 205 grams of pentolite (a 50/50 PETN/TNT mixture) were detonated underwater and a series of detonators of various manufacture were placed at varying distances from the explosive charges. The pressure generated by the explosive charge at various distances is shown below in Table 1. Sympathetic instantaneous detonation of of each detonator tested is indicated opposite the pressure at which it detonated.

Sample 1 is a commercial delay detonator of the type described in FIG. 1. Sample 2 is identical to the delay detonator of FIG. 1 except that it also comprises the wiper ring as described in U.S. Pat. No. 4,821,646. Sample 3 is a delay detonator, according to the present invention, as described in FIG. 2.

It is shown in Table 1, that the detonator of the present invention, Sample 3, was detonated at a pressure of 20,500 psi while competitive products, Samples 1 and 2, were detonated at a lesser pressure of 19,000 psi.

TABLE I

UNDERWATER SHOCK TEST RESULTS

| Distance from Primer (cm) | Pressure Rating (psi) | Sample 1 (comp.) | Sample 2 (Wiper Ring) | Sample 3 (present invention) |
|---|---|---|---|---|
| 50 | 9,000 | | | |
| 47.5 | 9,750 | | | |
| 45 | 10,500 | | | |
| 42.5 | 11,250 | | | |
| 40 | 12,000 | | | |
| 37.5 | 13,000 | | | |
| 35 | 14,000 | | | |
| 32.5 | 15,000 | | | |
| 30 | 16,000 | | | |
| 27.5 | 17,500 | | | |
| 25 | 19,000 | * | * | |
| 22.5 | 20,500 | | | * |
| 20 | 22,000 | | | |

*Pressure of Instantaneous Detonation

EXAMPLE 2

It has been surprisingly found that detonators show an increased sensitivity to shock initiation during the period when the internal delay charge is burning, i.e. after the ignition charge has ignited the delay charge but before the delay charge has had time to burn through to the priming charge. Tests similar to those of Example 1 were undertaken on the same detonator samples which were in the ignition or burning mode. The results given below in Table 2 clearly show the improved shock resistance of the detonator of the present invention.

TABLE 2

UNDERWATER SHOCK TEST RESULTS WHEN DETONATORS ARE IGNITED

| Distance from Primer (cm) | Pressure Rating (psi) | Sample 1 (comp.) | Sample 2 (Wiper Ring) | Sample 3 (present invention) |
|---|---|---|---|---|
| 50 | 9,000 | | | |
| 47.5 | 9,750 | | | |
| 45 | 10,500 | | | |
| 42.5 | 11,250 | | | |
| 40 | 12,000 | * | | |
| 37.5 | 13,000 | | | |
| 35 | 14,000 | | * | |
| 32.5 | 15,000 | | | |
| 30 | 16,000 | | | |
| 27.5 | 17,500 | | | |
| 25 | 19,000 | | | * |
| 22.5 | 20,500 | | | |
| 20 | 22,00 | | | |

*Pressure of Instantaneous Detonation

Sample 3 is clearly superior to samples 1 and 2 in that instantaneous detonation was not observed until pressures of 19,000 psi. were obtained. In comparison, samples 1 and 2 detonated at pressures of 12,000 and 14,000 psi., respectively.

EXAMPLE 3

In order to further demonstrate the improved shock resistance of the detonator of the present invention, a card gap test was employed. In this test, a series of paper cards (playing cards) 0.011 inches (0.279 mm) in thickness were used to separate a detonator from a donor charge of 20 gram/ft detonating cord. All detonators tested had the same base charge of PETN. The results are shown in Table 3 below where the number of cards is the minimum number to prevent initiation of the detonator.

TABLE 3

| Sample | No. of Cards |
|---|---|
| Prior Art Detonator (FIG. 1) | 25-36 cards |
| Wiper Ring Detonator without Inner Secondary Shell | 12-14 cards |
| Detonator of Present Invention | 3 cards |

From the foregoing, it is apparent that the novel detonator of the invention provides a substantial improvement in shock resistance compared to all conventional or known products tested.

We claim:

1. A time-delay blasting initiator comprising a principal tubular metal shell closed at one end, a base charge of explosive within said principal shell, a priming charge adjacent said base charge, a delay charge adjacent said priming charge and an ignition means adjacent said delay charge, characterized in that said initiator further comprises a secondary shell being of smaller diameter than said principal shell and so positioned within said principal shell as to provide a circumferential void space, and wherein at least one of said base charge, said priming charge and said delay charge is contained within said secondary shell.

2. A blasting initiator as claimed in claim 1 wherein said one end of said secondary shell is closed, and said base charge, said priming charge and a major part of said delay charge are contained within said secondary shell.

3. A blasting initiator as claimed in claim 1, wherein said secondary shell and said principal shell are maintained separated by means of a resilient ring-shaped spacer element therebetween.

4. A blasting initiator as claimed in claim 1, wherein the said principal shell is manufactured from a metal which is resistant to deformation.

5. A blasting initiator as claimed in claim 4, wherein said metal is copper or steel.

6. A blasting initiator as claimed in claim 1, wherein said void space is filled with an energy absorbing material.

7. A blasting initiator as claimed in claim 1, additionally comprising a wiper ring located at the interface between said priming charge and a delay train, which delay train house said delay charge.

* * * * *